US011026553B2

(12) United States Patent
Ross et al.

(10) Patent No.: US 11,026,553 B2
(45) Date of Patent: Jun. 8, 2021

(54) CURVED MOP AND RELATED METHOD

(71) Applicant: CONTEC, INC., Spartanburg, SC (US)

(72) Inventors: Layne Z Ross, Simpsonville, SC (US); James Ireland, Greenville, SC (US)

(73) Assignee: CONTEC INC., Spartanburg, SC (US)

( * ) Notice: Subject to any disclaimer, the term of this patent is extended or adjusted under 35 U.S.C. 154(b) by 250 days.

(21) Appl. No.: 16/120,831

(22) Filed: Sep. 4, 2018

(65) Prior Publication Data

US 2019/0075996 A1 Mar. 14, 2019

Related U.S. Application Data

(60) Provisional application No. 62/556,023, filed on Sep. 8, 2017.

(51) Int. Cl.
*A47L 13/44* (2006.01)
*A47L 13/256* (2006.01)

(52) U.S. Cl.
CPC ..... *A47L 13/256* (2013.01); *A47L 13/44* (2013.01)

(58) Field of Classification Search
CPC ..... A47L 13/256; A47L 13/254; A47L 13/44
See application file for complete search history.

(56) References Cited

U.S. PATENT DOCUMENTS

| | | | | |
|---|---|---|---|---|
| 3,792,505 A * | 2/1974 | Saltzstein | A47L 13/256 | 15/231 |
| 8,800,092 B1 * | 8/2014 | Morad | A47L 13/256 | 15/147.1 |
| 9,072,419 B1 * | 7/2015 | Morad | A47L 13/24 | |
| 2001/0013153 A1 * | 8/2001 | Zorzo | A47L 13/258 | 15/247 |

* cited by examiner

*Primary Examiner* — Michael D Jennings
(74) *Attorney, Agent, or Firm* — J.M. Robertson, LLC

(57) ABSTRACT

A mop tool incorporating a resilient deformable polymer mop head adapted to operatively connect to an elongated handle. The mop head has a concave lower face for positioning in opposing relation to a disposable cleaning element. Hooking elements project downwardly away from the lower face for operative engagement with the disposable cleaning element. The concave lower face defines a resilient collapsible arch having an apex substantially at the center of the mop head.

10 Claims, 4 Drawing Sheets

CURVED MOP AND RELATED METHOD

CROSS REFERENCE TO RELATED APPLICATIONS

This nonprovisional application claims the benefit of, and priority from, U.S. provisional application 62/556,023 filed Sep. 8, 2017. The contents of such prior application and all other documents referenced in this application are hereby incorporated by reference in their entirety as if fully set forth herein.

TECHNICAL FIELD

The present disclosure relates generally to cleaning products, and more particularly to a mop tool adapted for operative connection to a disposable cleaning element. The mop tool incorporates a resilient mop frame (also referred to as a mop head) adapted for attachment to an elongated handle. The mop frame incorporates a lower surface adapted for reversible engagement with an upper surface of the disposable cleaning element.

BACKGROUND

Flat mopping is the standard configuration used for most household, commercial and industrial surface cleaning requirements. Under normal mopping forces exerted by an operator during use, it has been found that the mop frames are not fully rigid along the long axis of the mop head thereby allowing for some deflection to occur. During the mopping operation, when force is applied to the handle, pressure is concentrated at a central attachment point at the intersection between the handle and the mop frame. However, this central downward force decreases toward the edges of the frame's extremities. Thus, the pressure applied to the underlying surface being cleaned may be relatively high at the center of the mop frame, while being relatively low at the edges. This pressure differential may lead to non-uniform cleaning such that the zones at the ends of the mop frame are less effective than the zones near the central handle attachment.

Without being constrained to any particular theory, it is believed that the reduction in applied force at the ends of the mop frame is due to the deflection of the mop frame during use as pressure is applied through the mop frame by a user. This deflection is believed to cause the mop frame to bend away from its unstressed flat condition towards a condition in which the underside is slightly convex and the ends of the mop frame remote from the handle are raised slightly away from the surface being cleaned. As a result, cleaning performance may not be uniform across the full surface of the mop frame. In particular, cleaning performance may be substantially reduced at the terminal ends of the mop frame remote from the central handle attachment. Moreover, the application of additional force by a user may be ineffective to address this problem since such additional face may actually increase the deflection and cause the terminal ends to lift further away from the surface to be cleaned.

It is generally known that mop frames may use hook and loop type attachment systems to secure a cleaning element in place across the lower surface of the frame. In such arrangements, a plurality of hooking elements may extend downwardly from the underside of the frame for reversible attachment to loops on the upper surface of the cleaning element to form a hook and loop style attachment. However, in flat frames the hooks may tend to accumulate fibers, hair, and the like over time. The collection of such debris may tend to make the hooks less receptive to holding a loop-backed fabric or other cleaning element. This debris collection may be particularly problematic if a user places the mop frame flat on a floor or other surface without a cleaning element attached.

It is also generally known to use disposable cleaning products for attachment to mop frames which incorporate substantial quantities of microfiber. Such products may provide substantial cleaning benefits due to the high surface area created by the microfibers. However, this large surface area across a flat mop frame may also lead to so called "stiction" wherein the mop becomes increasingly difficult to move during use due to the large surface area in contact with the floor and a corresponding vacuum effect.

In light of the various noted problems associated with current flat mop frames, an alternative construction which eliminates such problems would represent a useful advancement over the current art.

SUMMARY

The present disclosure offers advantages and alternatives over the prior art by providing a mop tool incorporating a deformable mop frame having a normally concaved lower face defining an arch spanning the major length dimension of the mop frame. The lower face is adapted for reversible operative engagement with an upper surface of a disposable cleaning element. During a mopping operation, the curved frame flexes as pressure is applied by a user through the handle to at least partially flatten the concave curvature across the lower surface. The use of such a frame facilitates the application of more even pressure along the entire face during use. Such even pressure may provide enhanced cleaning and more efficient use of the disposable cleaning elements.

In accordance with one exemplary aspect, the present disclosure provides a mop tool including a polymer mop head with a substantially centrally located attachment structure adapted to operatively connect to an elongated handle structure. The mop head further includes a lower face having a concave arched profile such that the lower surface defines an arch having an apex disposed at a position in underlying opposing relation the attachment element. Hooking elements project away from the lower face and are adapted to engage a surface of a disposable cleaning element in hook and loop connection. The mop head is flexibly resilient such that the arch will collapse upon application of force corresponding to normal mopping through the handle structure and will thereafter recover upon removal of the applied force.

Other features and advantages of the disclosure will become apparent to those of skill in the art upon review of the following detailed description, claims and drawings.

Figure 1:
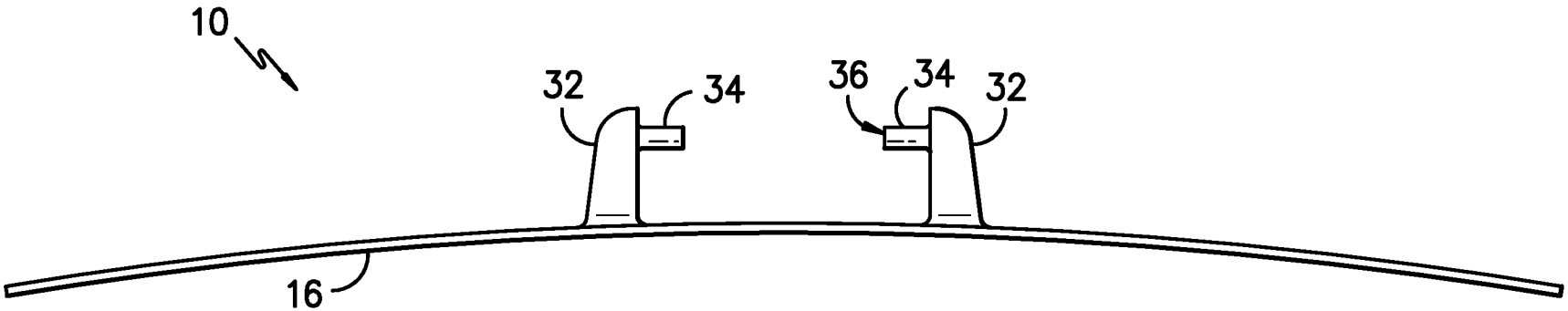
FIG. 1 is a lateral side view schematic illustrating an exemplary mop frame consistent with the present disclosure.
Figure 2:
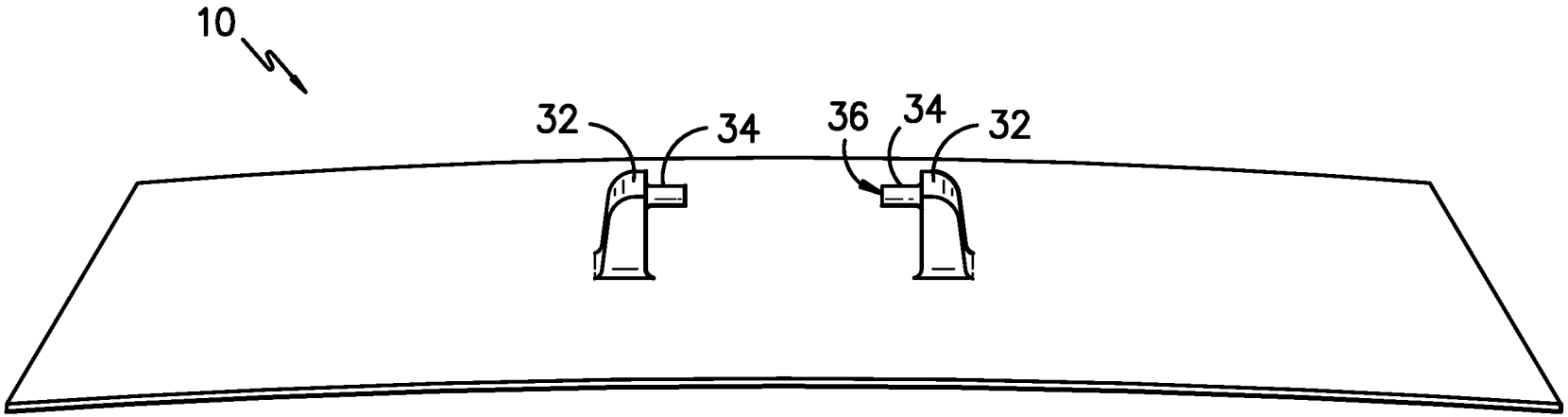
FIG. 2 is an elevation perspective schematic illustrating the exemplary mop frame of FIG. 1.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF THE PREFERRED EMBODIMENTS

Figure 4:
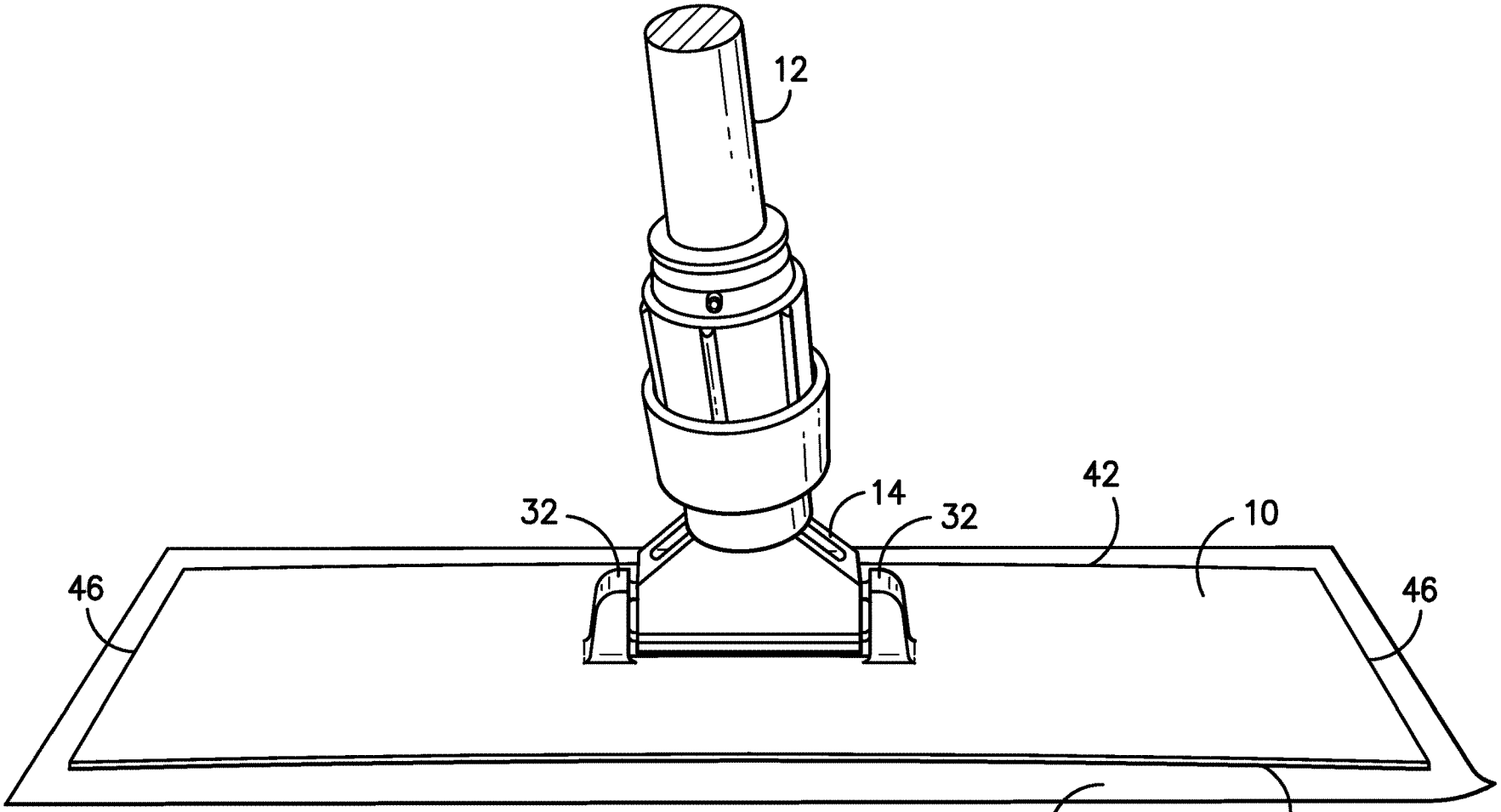
FIG. 4 is a schematic elevation perspective view of a mop tool consistent with the present disclosure incorporating an arched flexible mop frame with an attached handle and an underlying disposable cleaning element.

Exemplary embodiments of the disclosure will now be described through reference to the drawings wherein like reference numerals are used to designate like elements in the various views. Referring now to the drawings, an exemplary mop frame 10 (also referred to as a mop head) is illustrated. As will be described further hereinafter, the mop frame 10 is adapted to be connected in pivoting relation to an elongated handle 12 (FIG. 4) through a suitable connection element 14 as will be known to those of skill in the art.

As shown, in the illustrated exemplary mop frame, a concave arc with a defined radius of curvature is designed into the lower face 16 of the mop frame 10. Thus, in an unstressed state, the mop frame 10 will have a generally bowed construction with a concave lower face 16. As noted previously, integral hooking elements 20 (shown in greatly enlarged detail in FIG. 3) may be disposed in a discontinuous pattern across the concave lower face 16 for direct attachment to cooperating loop elements on an opposing upper surface of a disposable cleaning element 30 such as a pad or wipe. This engagement establishes a reversible hook and loop connection such that the cleaning element 30 may be disengaged from the mop frame 10 by application of a modest shear force in a well-known manner. Thus, it is typically not necessary to fold the disposable cleaning element 30 over the edges of the mop frame 10 for attachment.

As shown, the exemplary mop frame 10 may include a pair of upstanding posts 32 with opposing projections 34 extending inboard from the posts to define a stirrup structure 36 for operative connection to the elongated handle 12. In this regard, while a gap is illustrated between the opposing projections 34, it is likewise contemplated that the projections may define a unitary cross bar extending the full width between the posts if desired. By way of example only and not limitation, connection to the handle 12 may utilize a resilient connection element 14 (FIG. 4) of the type shown and described in U.S. Pat. No. 7,574,777 to Fuller et al. (incorporated by reference). However, other suitable connection elements as may be known to those of skill in the art may likewise be utilized if desired.

As illustrated, in the exemplary construction, the handle 12 is attached generally at the center of the mop frame 10 such that the posts 32 are disposed along a line substantially bisecting the mop frame 10 in the width dimension and with the ends of the mop frame 10 projecting laterally outward from either side of the stirrup structure 36 in the major length dimension. In this regard, the curvature across the lower face 16 defines an arch spanning the major length dimension between the two lateral ends with the apex of the curve being generally at the center of the mop frame 10 beneath the handle attachment. In accordance with a one exemplary construction, curvature is restricted to the major length dimension such that there is substantially no curvature in the minor (forward to aft) width dimension. However, such curvature may be included if desired.

The mop frame 10 is preferably formed as a one-piece molded structure from a resilient plastic material using a technique such as injection molding or the like. The mop frame 10 is formed with a thickness such that the application of downward force through the handle 12 to the stirrup structure 36 will cause the mop frame 10 to flex away from its unstressed bowed condition and towards a flattened condition during normal cleaning use.

As noted previously, in accordance with the exemplary operating practice, as an operator applies pressure through the handle 12 during use, the mop frame 10 will flatten to reduce or eliminate the curvature across the lower face 16. Surprisingly, it has been found that this flattening may be accomplished without resultant delamination of attached cleaning elements. It has been found that by matching the frame material with the appropriate arc radius, a mop frame 10 can provide enhanced uniformity in pressure along the full length of the mop face during use. Thus, a floor or other flat surface may receive more uniform cleaning.

In accordance with the illustrated and potentially preferred practice, the mop frame 10 preferably has an elongated aspect ratio such that the maximum length dimension is at least two times greater than the maximum width dimension. In this regard, substantially rectangular configurations may be beneficial. However, it is likewise contemplated that any number of other geometries including ovals, ellipses, straight-sided ovoids and the like may be used if desired. By way of example only, one exemplary construction for the mop frame 10 uses a substantially rectangular construction of molded polypropylene having a thickness of about 0.125 inches, an end to end length of about 17.5 inches and a forward to aft width of about 4 inches between a forward edge 42 and a rear edge 44. However, it is to be understood that other polymers including polyester, Nylon and the like may also be used if desired. Likewise, different geometries and dimensions may be used if desired.

In accordance with one exemplary construction, the radius of curvature along the major length dimension is such that in an unstressed condition, the center of the mop frame 10 at the lower face is preferably at least 1 inch higher than the ends without bearing the weight of a handle and will be at least 0.5 inches bearing the weight of an attached handle. Such a construction permits the desired deflection at the center without the required application of undue downward force by a user. In this regard, in accordance with a potentially preferred construction, the resilience of the mop frame 10 may be such that a downward force (including the force component from the weight of the handle) of at least 0.5 pounds force, and more preferably at least 0.75 pounds force, and most preferably at least 1.0 pounds force applied in a line perpendicular to the center of the mop frame may be required to deflect the arc and bring the mop frame to a fully flattened condition. In this regard, it is to be understood that during a normal mopping operation force will be applied through the handle with both vertical and horizontal force components. The vertical force component provides the desired deflection if the threshold for deflection is met or exceeded. The application of force below the threshold may provide some degree of deflection but will not result in complete flattening.

By providing a more constant downward force across the full lower face 16 during use, several benefits may be achieved. First, the mop user is assured that foreign material on the surface being cleaned is evenly removed since non-linear forces may create a situation of non-uniform removal of dirt, debris and/or contamination. Such uniform dirt removal is particularly beneficial in critical environments such as hospitals and the like to provide a high level of confidence in the final state of cleanliness. Second, since there is more uniform downward pressure across the frame face, the disposable cleaning element which is attached to the frame surface, also comes into even contact with the surface to be cleaned. By doing so, the total surface of the textile mop is better utilized.

Aside from the direct cleaning benefits, the exemplary mop frame 10 of the present disclosure also reduces the potential for collection of debris within downwardly projecting hooking elements. In particular, because of the bow in the lower face 16, when the exemplary mop frame 10 is placed on the floor without a pad or other cleaning element attached, the majority of hooking elements 20 remain lifted off the floor and tend not to get contaminated. In this regard, the use of low profile the hooking elements 20 which extend away from the lower face 16 a distance of not more than about 25% of the maximum arch height, and more preferably not more than about 10% of the maximum arch height and most preferably not more than about 5% of the maximum arch height may be particularly beneficial. Of course, hooking elements 20 with other lengths may also be used if desired.

Figure 3:
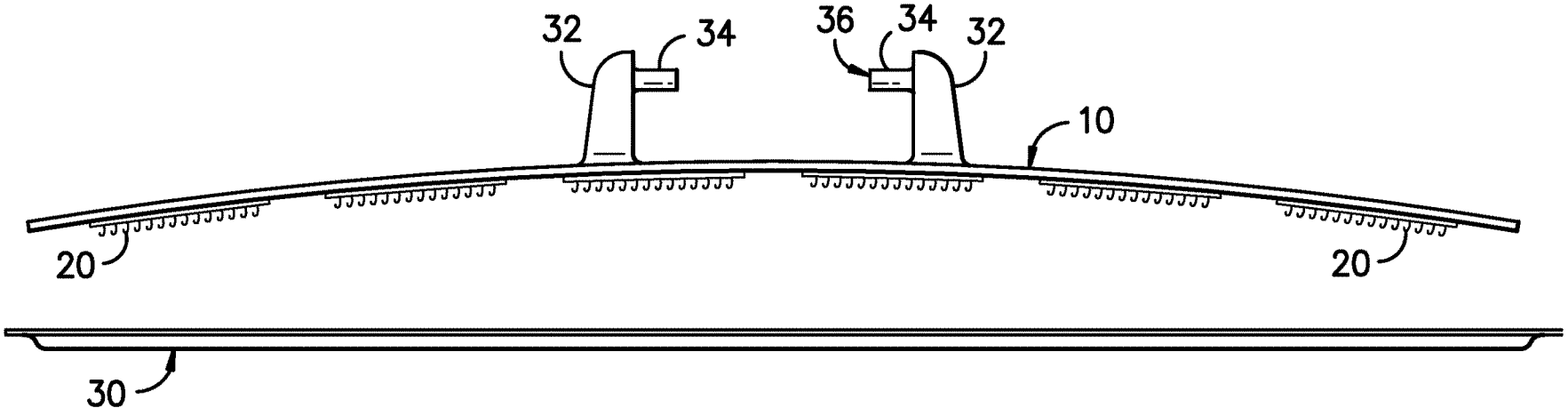
FIG. 3 is a lateral side view schematic illustrating an exemplary mop frame consistent with the present disclosure adapted for hook and loop attachment to an underlying disposable cleaning element.
Figure 5:
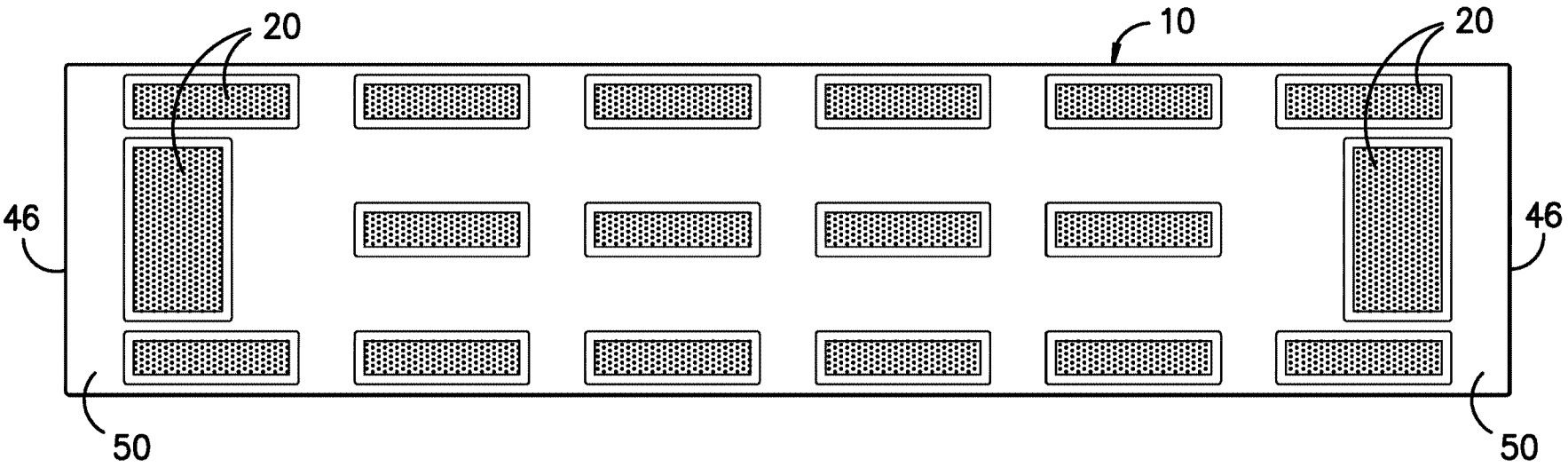
FIG. 5 is a schematic plan view of the underside of the exemplary mop frame of FIG. 3.

As best illustrated through joint reference to FIGS. 3 and 5, the hooking elements 20 may be disposed across the concave lower surface of the mop frame 10 in a discontinuous pattern of blocks defining discrete attachment zones with substantially smooth interstitial zones free from hooking elements. Such a discontinuous pattern is believed to facilitate a degree of readjustment between the mop frame 10 and an underlying disposable cleaning element 30 as the mop frame deflects and recovers during use. End zones 50 which are free from hooking elements and thereby provide a substantially smooth surface at the ends of the length dimension between the forward edge 42 and the rear edge 44 may also be beneficial in facilitating such self-adjustment.

An exemplary mop frame 10 consistent with the present disclosure may also reduce the previously noted problem of so called "stiction" wherein the mop becomes increasingly difficult to move during use due to the large surface area in contact with the floor or other surface being cleaning and a corresponding vacuum effect. In this regard, because the exemplary mop tool is flexible, if an operator encounters undue resistance due to stiction, the simple elimination of downward pressure will cause the mop frame 10 to spring back to its normal bow shape, thereby pulling the mop slightly away from the cleaning surface thereby reducing friction and any vacuum effect. The cleaning operation may then be resumed without difficulty.

It is to be understood that preferred embodiments of this invention are described herein, including the best mode known to the inventors for carrying out the invention. However, variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein. The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Various features of the invention are set forth in the following claims.

What is claimed is:

1. A mop tool comprising: a polymer mop head, the mop head including a substantially centrally located attachment element projecting away from an upper surface of the mop head, the attachment element being adapted to operatively connect to an elongated handle structure, the mop head further including a lower face having a concave arched profile such that the lower surface defines an arch having an apex disposed at a position in underlying opposing relation the attachment element, a plurality of hooking elements projecting away from the lower face, the hooking elements being disposed in attachment zones adapted to engage a surface of a disposable cleaning element in hook and loop connection, the lower face further including zones free from hooking elements including hook-free end zones defining substantially smooth surfaces, the hooking elements having a length not greater than 25% of the height of the arch at the apex, wherein the mop head is flexibly resilient such that the arch will fully deflect to a flat condition upon application of a vertical force of 0.5 pounds force or greater through the handle structure during mopping use and the arch will thereafter recover upon removing the force applied through the handle structure.

2. The mop tool as recited in claim 1, wherein the mop head is of one-piece, molded polymer construction.

3. The mop tool as recited in claim 1, wherein the mop head is of substantially rectangular profile having a length dimension and a width dimension.

4. The mop tool as recited in claim 3, wherein the length dimension is at least two times greater than the width dimension.

5. The mop tool as recited in claim 1, wherein the attachment element is a stirrup structure comprising a pair of spaced-apart posts projecting away from an upper surface of the mop head and a pair of opposing projections extending inboard from the posts.

6. The mop tool as recited in claim 5, wherein the mop head is of substantially rectangular profile having a length dimension and a width dimension and wherein the posts are disposed along a centerline bisecting the width dimension.

7. The mop tool as recited in claim 1, wherein the mop head is of substantially rectangular profile having a length dimension and a width dimension, the lower face having a concave arched profile in the length dimension and a substantially flat profile in the width dimension.

8. The mop tool as recited in claim 1, wherein the hooking elements have a length not greater than 10% of the height of the arch at the apex.

9. The mop tool as recited in claim 1, wherein the hooking elements have a length not greater than 5% of the height of the arch at the apex.

10. A mop tool comprising: a one-piece, molded polymer mop head of substantially rectangular profile having a length dimension and a width dimension, wherein the length dimension is at least two times greater than the width dimension, the mop head including a substantially centrally located stirrup structure defining an attachment element adapted to operatively connect to an elongated handle structure, wherein the stirrup structure comprises a pair of spaced-apart posts projecting away from an upper surface of the mop head and a pair of opposing projections extending inboard from the posts, the mop further including a lower face having a concave arched profile such that the lower surface defines an arch having an apex disposed at a position in underlying opposing relation the attachment element, a plurality of hooking elements projecting away from the lower face, the hooking elements being disposed in attachment zones adapted to engage a surface of a disposable cleaning element in hook and loop connection, the lower face further including interstitial zones free from hooking elements and hook-free end zones defining substantially smooth surfaces, the hooking elements being adapted to engage a surface of a disposable cleaning element in hook and loop connection, the hooking elements having a length not greater than 5% of the height of the arch at the apex, wherein the mop head is flexibly resilient such that the arch will deflect to a flat condition upon application of a downward vertical force of 1 pound force or greater through the handle structure in a line perpendicular to the center of the mop frame during mopping use and the arch will thereafter recover upon removal the force through the handle structure.

* * * * *